US005953994A

United States Patent [19]

Seefried

[11] Patent Number: 5,953,994

[45] Date of Patent: Sep. 21, 1999

[54] PRINTING UNIT OF ROTARY PRINTING PRESSES

[75] Inventor: Karl-Heinz Seefried, Zuzenhausen, Germany

[73] Assignee: Heidelberger Druckmaschinen Aktiengesellschaft, Heidelberg, Germany

[21] Appl. No.: 09/006,735

[22] Filed: Jan. 14, 1998

[30] Foreign Application Priority Data

Jan. 16, 1997 [DE] Germany ..... 297 00 662 U
Aug. 29, 1997 [DE] Germany ..... 197 37 783

[51] Int. Cl.[6] ..... B41F 35/00

[52] U.S. Cl. ..... 101/424; 101/425

[58] Field of Search ..... 101/424, 425, 101/423; 15/256.5, 256.51, 256.52

[56] References Cited

U.S. PATENT DOCUMENTS

| | | | |
|---|---|---|---|
| 4,393,778 | 7/1983 | Kaneko | 101/425 |
| 4,747,348 | 5/1988 | Jeschke et al. | 101/425 |
| 5,010,819 | 4/1991 | Uribe et al. | 101/423 |
| 5,207,160 | 5/1993 | Harada | 101/423 |
| 5,209,164 | 5/1993 | Durrnagel et al. | 101/423 |
| 5,732,631 | 3/1998 | Walther et al. | 101/424 |

FOREIGN PATENT DOCUMENTS 4343692 6/1995 Germany .

OTHER PUBLICATIONS

Bresnick, "Vacuum–less Cleaning and Reclaim System for Magnetic Toner/Media", Xerox Disclosure Journal. vol. 5. No. 4, Jul. 8, 1980.

*Primary Examiner*—Edgar Burr
*Assistant Examiner*—Anthony H. Nguyen
*Attorney, Agent, or Firm*—Nils H. Ljungman & Associates

[57] ABSTRACT

A printing unit of rotary printing presses with a cleaning device is disclosed wherein the cleaning device can be applied against the surface of a cylinder to be cleaned. The cleaning device has a driven roller located in a housing, which roller is in the vicinity of an opening in the housing, which opening faces the cylinder. The cleaning device also has a cleaning agent feed device corresponding to the washing roller, and a wiper strip, whereby the cleaning device extends over the length of the cylindrical surface of the cylinder, and contains structure for the easy removal of the dirty cleaning fluid.

12 Claims, 1 Drawing Sheet

PRINTING UNIT OF ROTARY PRINTING PRESSES

BACKGROUND OF THE INVENTION

1. Field of the Invention

The present invention relates to a printing unit of a rotary printing press with a cleaning device, which cleaning device can be applied against, or positioned in relation to, a cylinder to be cleaned. The cleaning device can have a driven washer roller which washer roller is located in a housing in the vicinity of an opening in the housing, which opening faces the cylinder. The cleaning device can also have a cleaning agent feed device corresponding to the washing roller and a wiper strip. The cleaning device extends over the length of the cylindrical surface of the cylinder.

2. Background Information

German Patent No. 43 43 692 A1 shows a similar known device, in which a washing roller is used. The washing roller contains bristles and is located in a closed housing. On the housing there is a drain or discharge for the dirty washing fluid, which drain is connected to a container or tank by means of a connecting hose. The used washing fluid must then be disposed of.

On modern printing presses, the washing of a cylinder is performed with very little washing agent. The solvents which are used for cleaning are also extremely volatile. Consequently, the dirty washing fluid which runs off the washing roller collects in the lower portion of the housing, where a large part of the volatile solvents evaporate, so that only a small portion of the used washing fluid actually makes it to the discharge. Increasing quantities of used cleaning fluid dry up in the housing, to the point where in the known embodiment, the housing must be removed from the press for cleaning. To make matters worse, cleaning the housing is also an extremely difficult and time-consuming task. The closing devices used on the housing also tend to become stuck on account of the dirty washing fluid, and their removal entails additional time, effort and expense.

OBJECT OF THE INVENTION

The object of the present invention is to create a solution which makes it possible to easily remove the dirty cleaning fluid from the cleaning device and dispose of the dirty cleaning fluid.

SUMMARY OF THE INVENTION

The present invention teaches that this object can be achieved by realizing the lower portion of the housing in the form of a collecting pan which collecting pan is detachably connected to the upper portion of the housing. This collecting pan can be removed from the housing, e.g. in the manner of a drawer, so that the used cleaning fluid which has collected in it can be very easily removed from the press and dumped into a waste container. Dried cleaning fluid can be removed from the collecting pan by the printing press operator, using a blade or trowel, for example, so that the cleaning device can be cleaned extremely quickly and economically, without requiring the removal of the cleaning device from the press. The present invention also teaches that it is unnecessary to detach the connecting lines from the cleaning device, which is a simple way to further increase operational reliability.

One advantageous embodiment of the present invention is characterized by the fact that the collecting pan is mounted on slide rails, runners or skids and is realized so that it can be pulled out. Also, there is a seal between the upper portion of the housing and the collecting pan. The mounting on slide rails and the seal of the collecting pan prevent the cleaning fluid from accidentally escaping from the device and soiling other parts of the press. In this case it is advantageous to realize the seal in the form of a encircling brush strip which does not interfere with the extraction of the collecting pan.

The above discussed embodiments of the present invention will be described further hereinbelow with reference to the accompanying FIGURE. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

One embodiment of the present invention is illustrated schematically in the accompanying drawing in which.

DESCRIPTION OF THE PREFERRED EMBODIMENT

Figure 1:
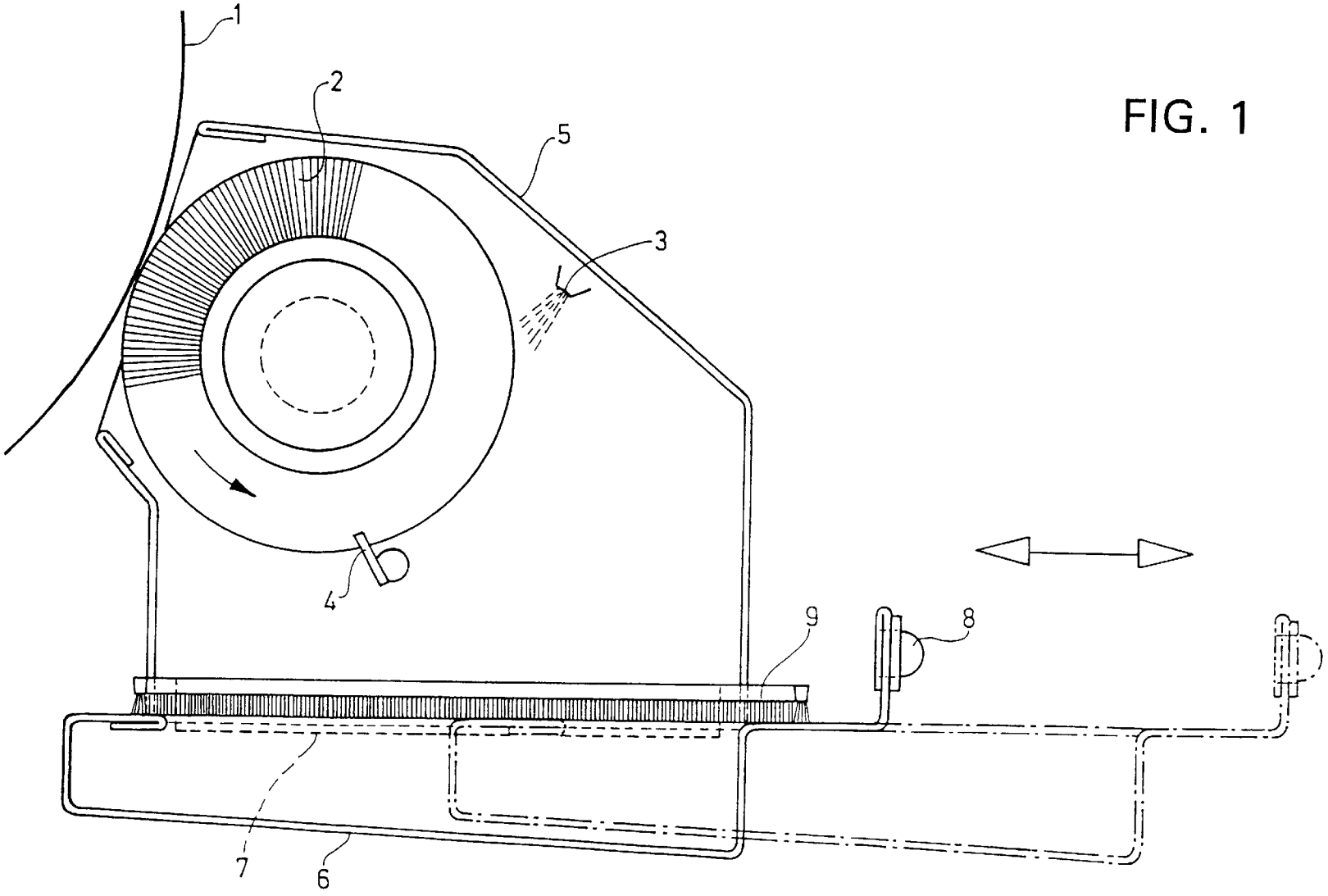
FIG. 1 shows a view of the cleaning device.

As shown in FIG. 1, the cylinder 1 of a rotary printing press can, for example, be a plate, blanket or printing cylinder, the cylindrical surface of which, after a certain amount of operating time of the printing press, can become soiled by dried-on ink residues or other particles of dirt. To achieve a correct printing result, the cylindrical surface of the cylinder 1 must preferably be cleaned at certain intervals, a process which is performed automatically in modern printing presses. For the cleaning process, a washing roller 2 is applied against the cylindrical surface of the cylinder 1 and a cleaning agent is applied to the rotating washing roller 2 by a cleaning agent feed device 3. The dirty cleaning agent is then removed from the washing roller 2 by a wiper strip 4. To prevent the soiling of the other parts of the press, the washing roller 2 with the cleaning agent feed device 3 and the wiper strip 4 are located in a housing 5.

The present invention teaches that the upper portion of the housing 5, which housing 5 contains the driven washing roller 2, is mounted between the side frames of the press. The lower portion of the housing 5 is realized in the form of a collecting pan 6, which collecting pan 6 is detachably connected to the upper portion of the housing 5. To mount the collecting pan 6 on the housing 5, slide rails 7 are attached to the upper portion of the housing 5, so that the collecting pan 6 can be pulled out manually. To facilitate the removal of the collecting pan 6, there is a handle 8 on the collecting pan 6, by means of which handle 8 the collecting pan 6 can be pulled out, e.g. into the position shown by the broken lines on FIG. 1.

To prevent an unintentional escape of dirty cleaning fluid from the cleaning device, there is a seal 9 on the upper portion of the housing 5, which seal 9 can be realized in the form of a brush strip. The seal 9 is fastened to the upper portion of the housing 5 on all sides or all the way around. The bristles of the brush strip can be supported against the upper portion of the collecting pan 6 and can thereby create a seal. Instead of slide rails 7, the collecting pan 6 can also be suspended on the upper part of the housing 5, or the collecting pan 6 can be mounted so that it swings out, in which case the connection between the collecting pan 6 and the housing 5 can be adapted to the conditions of the particular rotary printing press. It may also be necessary, for example, to remove the collecting pan 6 from the machine by the end or, alternatively, the short side, of the collecting pan, which removal can be realized easily by the present invention.

One feature of the invention resides broadly in the printing unit of rotary printing presses with a cleaning device which can be applied against the surface of a cylinder to be cleaned, with a driven roller located in a housing, which roller is in the vicinity of an opening in the housing, which opening faces the cylinder, with a cleaning agent feed device corresponding to the washing roller and with a wiper strip, whereby the cleaning device extends over the length of the cylindrical surface of the cylinder, characterized by the fact that the lower portion of the housing 5 is realized in the form of a collecting pan 6 which is detachably connected to the upper portion of the housing S.

Another feature of the invention resides broadly in the printing unit characterized by the fact that the collecting pan 6 is mounted on slide rails 7 and is realized so that it can be pulled out, and that there is a seal 9 between the upper portion of the housing 5 and the collecting pan 6.

Yet another feature of the invention resides broadly in the printing unit characterized by the fact that the seal 9 is realized in the form of an encircling brush strip, or a brush strip which runs all the way around.

The components disclosed in the various publications, disclosed or incorporated by reference herein, may be used in the embodiments of the present invention, as well as, equivalents thereof.

All, or substantially all, of the components and methods of the various embodiments may be used with at least one embodiment or all of the embodiments, if more than one embodiment is described herein.

All of the patents, patent applications and publications recited herein hereby incorporated by reference as if set forth in their entirety herein.

U.S. patent application Ser. No. 08/599,637, entitled "Drive for Distributor Rollers in an Inking Unit of a Rotary Printing Machine", filed on Feb. 9, 1996, and having the inventors Carsten Kelm and Rainer Klenk, is hereby expressly incorporated by reference as if set forth in its entirety herein.

Examples of rotary printing presses and devices to clean rotary printing presses or cylinders of rotary printing presses may be found in the following U.S. patent applications: Ser. No. 08/784402, Attorney Docket No. NHL-HBD-141, entitled "Device for Cleaning Cylinder Surfaces in Printing Presses", having the inventor Jens Friedrichs, and filed on Jan. 17, 1997; Ser. No. 08/801516, Attorney Docket No. NHL-HBD-144, entitled "Device For Cleaning Outer Cylindrical Surfaces of Cylinders in a Rotary Printing Machine", having the inventors Andre Geis and Thomas Kraft, filed on Feb. 18, 1997; Ser. No. 08/822590, Attorney Docket No. NHL-HBD-145, entitled "Cleaning Device Provided on a Rotary Printing Machine", having the inventors Willi Becker, Jens Friedrichs and Frank Kropp, filed on Mar. 20, 1997; Ser. No. 08/822250, Attorney Docket No. NHL-HBD-146, entitled "Cleaning Device Provided on a Rotary Printing Machine", having the inventors Willi Becker, Jens Friedrichs and Frank Kropp, filed on Mar. 20, 1997; and Ser. No. 08/854233, Attorney Docket No. NHL-HBD-155, entitled "Device and Method to Clean Cylinder Surfaces in Rotary Printing Presses", having the inventors Joachim Herrmann, Kurt Lotsch, Ralf Degner and Hendrik Stemmler, filed on May 9, 1997.

U.S. patent application Ser. No. 09/008,977, to be filed on or about Jan. 22, 1998, having the Attorney Docket No. NHL-HBD-160, having the inventor Karl-Heinz Seefried, entitled "Washing Device in the Printing Unit of Rotary Printing Presses", and claiming priority from Federal Republic of Germany Patent Application No. 197 02 082.8, filed on Jan. 22, 1997, is hereby expressly incorporated by reference as if set forth in its entirety herein.

The corresponding foreign and international patent publication applications, namely, Federal Republic of Germany Patent Application No. 297 00 662.2, filed on Jan. 16, 1997, and 197 37 783.1, filed on Aug, 29, 1997, having inventor Karl-Heinz Seefried, and DE-OS 297 00 662.2 and 197 37 783.1 and DE-PS 297 00 662.2 and 197 37 783.1.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A rotary printing press comprising:

a frame;

a printing unit cylinder to mount a printing plate;

said printing unit cylinder being rotatably mounted with respect to said frame;

a cleaning device;

said cleaning device being disposed and configured to clean a cylinder of the rotary printing press;

said cleaning device comprising:

a washing roller;

a housing;

said housing being disposed about said washing roller;

said housing comprising an opening therein;

said opening in said housing being configured to be disposed adjacent a cylinder to be cleaned;

said washing roller being disposed adjacent to said opening in said housing;

a cleaning agent feed device;

said cleaning agent feed device being disposed and configured to provide cleaning agent to said washing roller;

a wiper strip;

said wiper strip being disposed adjacent to said washing roller to remove cleaning agent from said washing roller;

said housing comprising a first portion and a second portion;

said second portion of said housing comprising a drawer-like pan to collect used cleaning agent from said first portion of said housing;

said drawer-like pan having a bottom and sides to contain used cleaning agent collected by said drawer-like pan;

said drawer-like pan being disposed and configured to slide with respect to said first portion of said housing and thus to be completely detachable from said first portion of said housing to permit emptying of the used cleaning agent contained in the drawer-like pan;

said pan being configured to be completely detachable from said first portion of said housing to permit removal of used cleaning agent from said pan;

said pan comprising a seal; and said seal being disposed between said pan and said first portion of said housing to minimize leakage of cleaning agent from said housing.

2. The printing press according to claim 1 wherein:

said first and second portions of said housing are directly connected to one another;

said first portion of said housing is a unitary housing portion; and said first portion of said housing is disposed to substantially enclose said washing roller and said wiper strip.

3. The printing press according to claim 2 wherein said cleaning device is configured to be disposed along the entire length of a cylinder to be cleaned.

4. The printing press according to claim 3 comprising:

at least one rail; and said pan being slidably mounted on said at least one rail.

5. The printing press according to claim 4 wherein:

said seal comprises a brush strip; and said brush strip is disposed about the periphery of said first portion of said housing.

6. The printing press according to claim 5 wherein said pan comprises a handle.

7. A cleaning device for a cylinder of a rotary printing press comprising:

a washing roller;

a housing;

said housing being disposed about said washing roller;

said housing comprising an opening therein;

said opening in said housing being configured to be disposed adjacent a cylinder to be cleaned;

said washing roller being disposed adjacent to said opening in said housing;

a cleaning agent feed device;

said cleaning agent feed device being disposed and configured to provide cleaning agent to said washing roller;

a wiper strip;

said wiper strip being disposed adjacent to said washing roller to remove cleaning agent from said washing roller;

said housing comprising a first portion and a second portion;

said first and second portions of said housing being directly connected to one another;

said first portion of said housing being a unitary housing portion;

said first portion of said housing being disposed to substantially enclose said washing roller and said wiper strip;

said second portion of said housing being configured to collect used cleaning agent;

said second portion of said housing comprising a drawer-like pan, said drawer like pan having a bottom and sides to contain used cleaning agent collected by said drawer-like pan;

said pan being configured to be completely detachable from said first portion of said housing;

a seal; and said seal being disposed between said pan and said first portion of said housing to minimize leakage of cleaning agent from said housing.

8. The cleaning device according to claim 7 wherein:

said drawer-like pan is configured and disposed to collect used cleaning agent from said first portion of said housing; and said drawer-like pan is disposed and configured to slide with respect to said first portion of said housing and thus to be completely detachable from said first portion of said housing to permit emptying of the used cleaning agent contained in the drawer-like pan.

9. The cleaning device according to claim 8 wherein said cleaning device is configured to be disposed along the entire length of a cylinder to be cleaned.

10. The cleaning device according to claim 9 comprising:

at least one rail; and said pan being slidably mounted on said at least one rail.

11. The cleaning device according to claim 10 wherein:

said seal comprises a brush strip; and said brush strip being disposed about the periphery of said first portion of said housing, between said first portion of said housing and said pan.

12. The cleaning device according to claim 11 wherein said pan comprises a handle.

* * * * *

UNITED STATES PATENT AND TRADEMARK OFFICE

CERTIFICATE OF CORRECTION

PATENT NO. : 5,953,994

DATED : September 21, 1999

INVENTOR(S) : Karl-Heinz SEEFRIED

It is certified that error appears in the above-identified patent and that said Letters Patent is hereby corrected as shown below:

In column 3, line 21, after 'housing', delete "S." and insert --5.--.

Signed and Sealed this

First Day of August, 2000

*Attest:*

Q. TODD DICKINSON

*Attesting Officer*

*Director of Patents and Trademarks*